United States Patent [19]

Hood et al.

[11] Patent Number: 4,720,054

[45] Date of Patent: Jan. 19, 1988

[54] SYSTEM FOR SUPPLYING STRIP TO A PROCESSING LINE

[75] Inventors: Walter J. Hood, Shaker Heights; Anthony C. Costello, Strongsville; Eugene L. Conaway, Twinsburg, all of Ohio

[73] Assignee: Kent Corporation, Cleveland, Ohio

[21] Appl. No.: 805,311

[22] Filed: Dec. 5, 1985

[51] Int. Cl.[4] ..... B65H 16/00; B65H 77/00

[52] U.S. Cl. ..... 242/58; 242/75.4; 242/105

[58] Field of Search ..... 242/105, 180, 128, 78.6, 242/75.52, 58, 75.4, 55

[56] References Cited

U.S. PATENT DOCUMENTS

| | | | |
|---|---|---|---|
| 1,178,566 | 4/1916 | Wright | 242/55 |
| 3,506,210 | 4/1970 | La Tour | 242/78.1 X |
| 3,534,918 | 10/1970 | Clark | 242/55 |
| 3,625,446 | 12/1971 | Floyd | 242/75.4 X |
| 3,815,837 | 6/1974 | Guthrie | 242/129 X |
| 3,889,891 | 6/1975 | Walker | 242/128 X |
| 4,022,396 | 5/1977 | Manchester | 242/129 X |
| 4,304,370 | 12/1981 | Box et al. | 242/78.6 |
| 4,582,271 | 4/1986 | Takahashi | 242/105 X |
| 4,610,408 | 9/1986 | Box et al. | 242/78.6 |

*Primary Examiner*—Stuart S. Levy
*Assistant Examiner*—Katherine Matecki
*Attorney, Agent, or Firm*—Renner, Kenner, Greive, Bobak & Taylor

[57] ABSTRACT

A system (10) for supplying strip material (S) to a processing line includes a strip uncoiler assembly (11) and a strip take-out assembly (12). The uncoiler assembly (11) carries a plurality of adjacently positioned coils (C) of strip material (S) with the trailing end of the strip material (S) of each coil (C) being attached to the leading end of the strip material (S) on the serially adjacent coil (C). The uncoiler assembly (11) also includes a drive mechanism (26) to rotate the coils (C) as the strip material (S) is payed off to the take-out assembly (12) which has a take-out arm (44) movable by an indexing device (73) to always be aligned with the individual coil (C) currently paying off strip material (S). Take-out assembly (12) also includes a dancer roller (57) which moves in response to the demand of the processing line to control the speed at which strip material (S) is payed off by the uncoiler assembly (11).

43 Claims, 6 Drawing Figures

11
13
C1
C2
C3
C4
C5
13
21
23
25
17
25
17
42
44
45
47
47
48
49
52
S
94
69
68
70
71
70
72
73
86
87
41
46
43
62
67
43
65
66
64
61
57
57
60
S
63
53
51
50
55
56
S
54
S
58
59

72
73
74
75
76
77
78
79
80
81
82
83
84
85
86
87
88
89
90
91
92
93
41

SYSTEM FOR SUPPLYING STRIP TO A PROCESSING LINE

TECHNICAL FIELD

This invention relates to a system for continuously supplying strip material stored on coils to a strip processing line. More particularly, this invention involves a system of joining the ends of several coils of strip together to effectively form one strip of material sufficiently long enough to satisfy the needs of a strip processing line for at least a day's work. The system also utilizes a strip take-out assembly to controllably pay off the strip from the coils to the processing line.

BACKGROUND ART

It is important for manufacturing lines which process strip material, such as steel, to operate continuously for at least an entire day or work shift. The strip material is usually coiled and positioned on an uncoiling device which is rotatable to pay off the strip to the processing line. In order to render the system continuous, usually a strip accumulating device, such as that shown in U.S. Pat. No. 3,506,210, is provided between the uncoiler and the processing line to store a sufficient quantity of strip therein so that the operator has time to weld the trailing end of the strip just depleted to the leading end of a new coil of strip positioned on the uncoiler.

This type of system has been very popular and successful but the cost thereof is often not economically justified for certain applications, such as processing lines operating at low speeds. The strip accumulators, in order to hold sufficient quantities of strip, often have to be quite large taking up much floor space. In addition, by utilizing the system just described, a welder must be positioned on-line between the uncoiler and accumulator so that the coils can be attached, and an operator must almost always be present. This too adds to the cost of the system. Furthermore, accumulators are not always workable with certain types of strip material. For example, many accumulators will not satisfactorily handle light gauge strip material or narrow strip material. Nor will they operate at high speeds without marking or otherwise damaging certain types of strip material. Finally, using these types of accumulators often requires that the trailing end of a coil just depleted be welded very quickly to the leading end of a new coil often resulting in poor welds or at least requiring an expensive end welder to assure a good weld.

None of the attempts to eliminate the need for accumulators or provide a suitable substitute therefor have been successful or practical. Of course, one huge coil could be provided which could carry a day's supply of strip but such would be so large and cumbersome that it could create more problems than it would solve. Because this would involve a time consuming and costly coil build-up operation, such large coils are not presently even commercially available.

U.S. Pat. No. 4,022,396 suggests that smaller coils could be stacked and interconnected but the device disclosed therein is not practical for many strips and most processing lines. There, the method of connecting and stacking the coils of strip puts undue stresses on all but the most flexible and thinnest of strips. Further, there is no suitable way disclosed in the patent to pay the vertically oriented strip off to the horizontally oriented processing line. Nor has any device been developed to adjust the height of the pay off to the processing line as strip is drawn from successive coils. The processing line must receive strip at a constant location, that is, a constant height. Only by placing the device of U.S. Pat. No. 4,022,396 a long and impractical distance from the processing line could this be accomplished. But most manufacturing facilities cannot afford to use that much floor space to accomplish this function. Finally, no one has developed any means to account for the varying tangential speeds at which the coil is payed out as one interconnected coil becomes depleted at a small diameter and a high rotational speed and quickly must slow down as coil is payed out from the outer diameter of a new coil at a considerably lower rotational speed.

In short, no one has developed a suitable substitute for the costly accumulator system which will operate as efficiently to continuously provide strip material to a processing line.

DISCLOSURE OF THE INVENTION

It is thus a primary object of the present invention to provide a system for continuously supplying strip material to a processing line without the need to utilize an accumulator.

It is another object of the present invention to provide a system, as above, which utilizes a plurality of interconnected coils which does not overstress the strip and which can be used with a wide variety of strip materials of different widths, thicknesses and coil diameters and which can be used for a wide variety of processing lines with varying speed demands.

It is a further object of the present invention to provide a system, as above, which provides strip to the processing line at the proper height and orientation.

It is still another object of the present invention to provide a system, as above, which provides strip to the processing line at the proper speed regardless of the rotational speed at which the interconnected coils are moving.

It is yet another object of the present invention to provide a system, as above, in which coils of different widths can be interconnected, should the processing line require the same, without changing uncoilers.

It is a still further object of the present invention to provide a system, as above, which can automatically, smoothly, change from one coil of strip material to the next coil of strip material as a coil is about to be depleted.

It is an additional object of the present invention to provide a system, as above, which is economical to manufacture, install and utilize, requiring a minimum of floor space.

These and other objects of the present invention, which will become apparent from the description to follow, are accomplished by the improvements hereinafter described and claimed.

In general, the system for supplying strip material to a processing line includes a strip uncoiler assembly and a strip take-out assembly. The uncoiler assembly includes a plurality of adjacently positioned coils of strip material with the trailing end of the strip material of each coil being attached to the leading end of the strip material on the serially adjacent coil. The uncoiler assembly also includes means to rotate the coils as the strip is payed off one of them to the take-out assembly. The take-out assembly includes means selectively alignable with the individual coil currently paying off strip material to receive the strip material and also includes means responsive to the demand of the processing line to control the rotational speed of the coils carried by the uncoiler assembly.

PREFERRED EMBODIMENT FOR CARRYING OUT THE INVENTION

Figure 1:
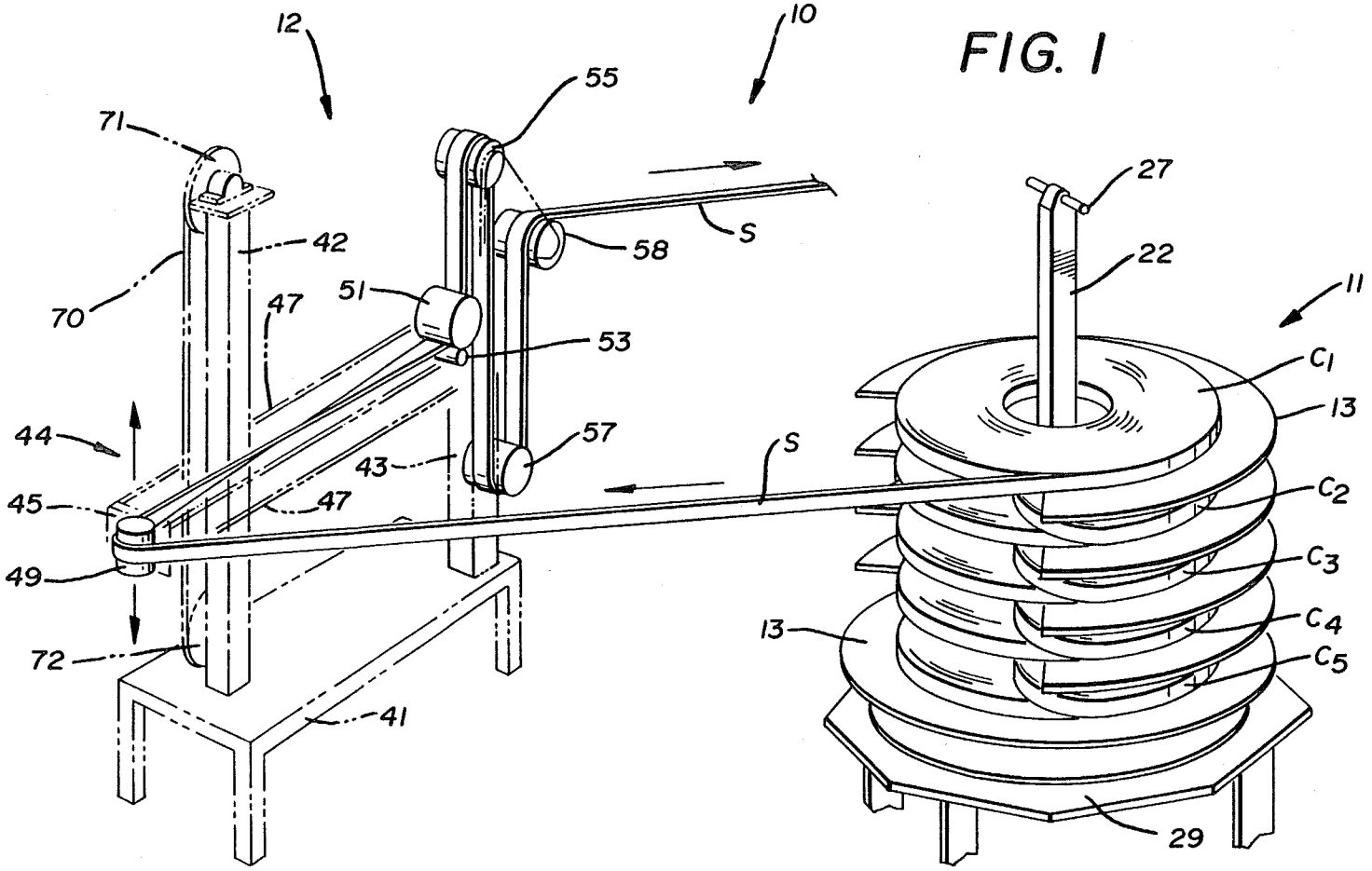
FIG. 1 is a somewhat schematic perspective view of the system for supplying strip material to a processing line according to the concept of the present invention with some of the details being omitted for clarity.

A system for supplying strip material to a processing line is indicated generally by the numeral 10 in FIG. 1 and includes an uncoiler assembly indicated generally by the numeral 11 and a take-out assembly indicated generally by the numeral 12. As schematically shown in FIG. 1, strip material S is provided to take-out assembly 12 from a plurality of interconnected coils of strip $C_1$, $C_2$, $C_3$, $C_4$ and $C_5$ of uncoiler assembly 11. While five coils are shown in this example, it should be evident that any number of coils could be provided. Usually, it will be desired to provide a sufficient amount of strip material to satisfy the needs of the processing line for at least a day's work. As will hereinafter be described in detail, strip S passes through take-out assembly 12 and then to the processing line.

The assembly of the coils of strip, which can take place at a remote location for subsequent mounting on the uncoiler assembly 11, can best be described with reference to FIG. 2. Each coil is placed on a support plate 13 the configuration of which is best shown in FIG. 3 as having an arcuate surface 14 which if continuous would define a circle. However, the circular nature of each plate 13 is interrupted by a generally sector-shaped cutout area defining surface 15. A square aperture 16 is provided at the point of the center of the circular arcuate surface 14, hereinafter referred to for convenience as the center of plate 13. Square reinforcing collars 17 extend from both sides of each plate 13 around aperture 16 to add structural stability to the plate. Extending upwardly from each plate 13 are three locating lugs 18 evenly positioned at 120° of each other around the center of the plate. Each plate may also be provided with a reinforcing skirt 19 on the underside thereof (FIG. 2) and the bottom plate may, if desired, include a more substantial reinforcing rib 20.

Figure 2:
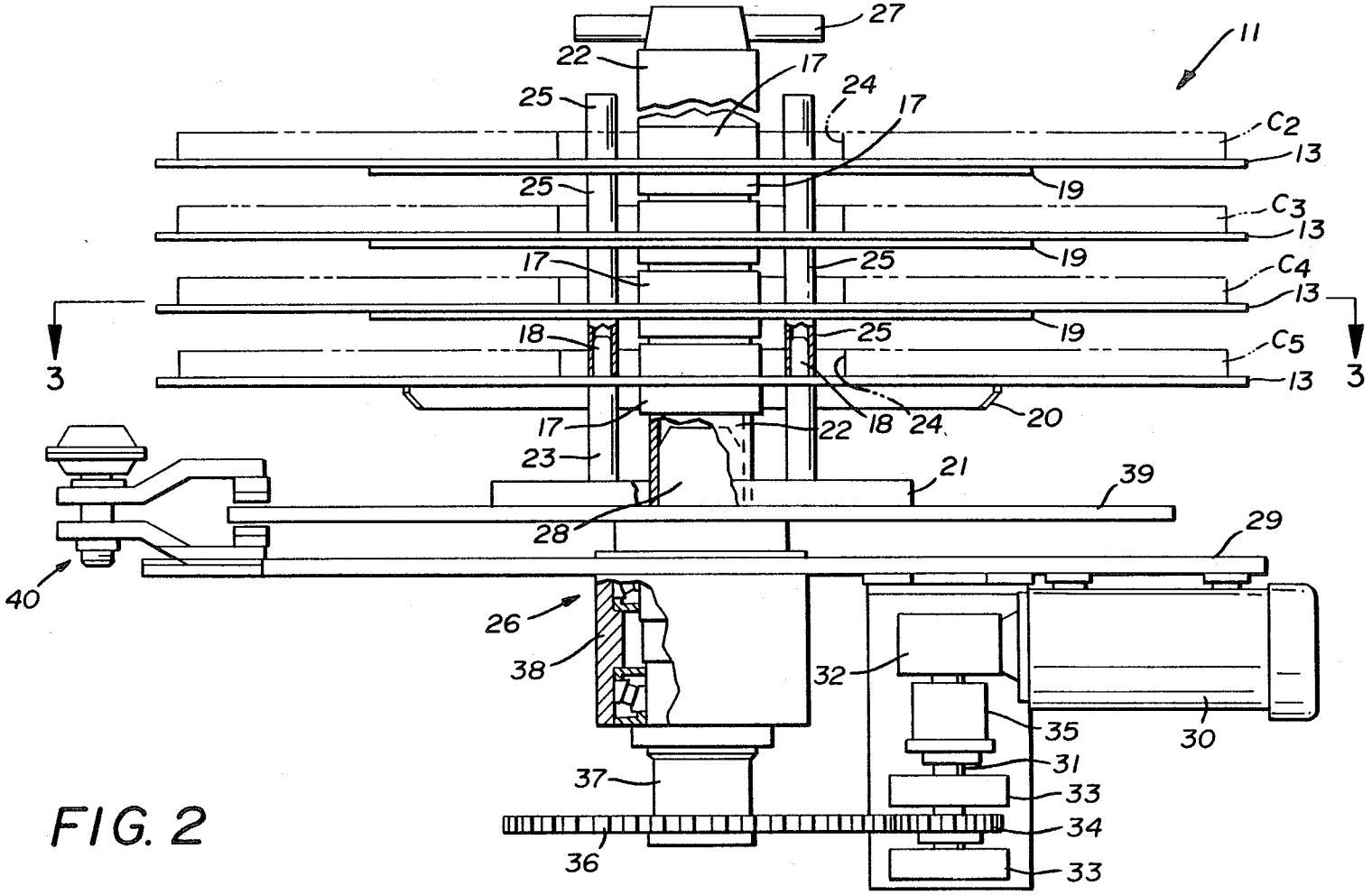
FIG. 2 is a partially sectioned elevational view of the uncoiler assembly shown in FIG. 1.
Figure 3:
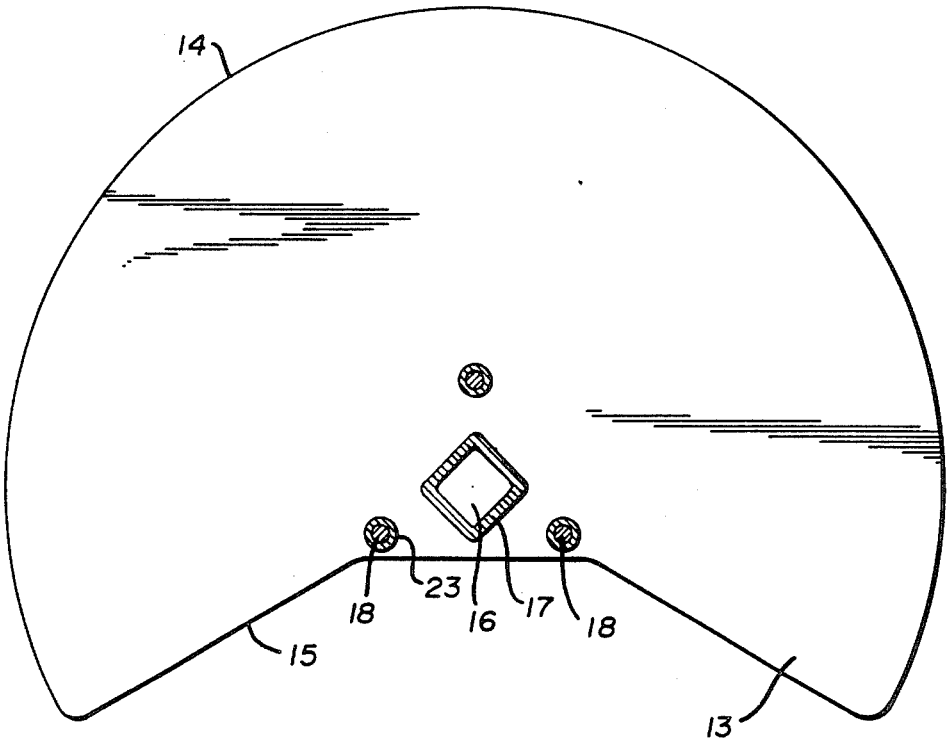
FIG. 3 is a sectional view taken substantially along line 3—3 of FIG. 2 showing only the coil support plate.

As shown in FIG. 2, the coils of material are supported on a base member 21 having a square hollow shaft 22 extending upwardly centrally therefrom. Support rods 23, generally aligned with locating lugs 18, carry the bottom plate 13 which is placed thereon by extending square shaft 22 through square aperture 16 of plate 13. Coil $C_5$ is placed on bottom plate 13 with the inner diameter or hub 24 thereof positioned around locating lugs 18. Hollow spacer and plate support cylinders 25 are positioned around locating lugs 18 to space plates 13 at selected distances. Usually the space between plates 13 should be about at least twice the width of the strip. Thus, if three inch wide strip were being processed, spacer cylinders 25 would be at least six inches high. By providing these spacer cylinders 25, the same plates 13 and other devices described herein can be used for processing a variety of strip widths and, in fact, coils of different strip widths can be stacked together if, for example, it is known that sometime during the work day the processing line will demand a strip of different width. Spacers 25 should be of such a diameter that the outer edges thereon will be within and therefore center hub 24 of the coil positioned therearound.

The desired number of coils can thus be stacked with each plate 13 being positioned on square shaft 22 and resting on appropriately sized spacer cylinders 25. The inner end or trailing end of each coil is attached, as by welding, to the outer end of the serially adjacent coil, thus attaching all the coils together to effectively form one long continuous strip of material. This is accomplished, for example, by pulling the inner wrap of material on coil $C_1$, passing it through the cutout area of plate 13 around surface 15 and downwardly to be attached to the outer wrap of material on coil $C_2$. Coil $C_2$ is similarly attached to coil $C_3$ which is similarly attached to coil $C_4$ which is similarly attached to coil $C_5$ in this example—as shown in FIG. 1.

The thus assembled coils may then be picked up and placed on the uncoiler drive mechanism generally indicated by the numeral 26 in FIG. 2. For ease in transport, the top of shaft 22 may be provided with a handle 27 for lifting by a factory transportation unit. The coil assembly is attached to the uncoiler drive mechanism 26 by extending hollow shaft 22 onto a rotatable generally square drive stub shaft 28 of drive mechanism 26, which will now be described in detail.

Drive mechanism 26 of uncoiler assembly 11 includes a stationary floor supported base plate 29 which carries a variable speed motor 30. Motor 30 turns shaft 31 through a gear reducer 32. Shaft 31 is supported by bearings 33 and carries a spur gear 34 which is rotated by shaft 31 extending through a coupling 35—all conventional drive train items. Spur gear 34 turns drive gear 36 which is mounted on the main uncoiler drive shaft 37. Drive shaft 37 is journalled through bearing assembly 38 and terminates as stub shaft 28. Shaft 37 also carries brake disc 39 for rotation therewith. A conventional caliper brake assembly 40 is mounted on base plate 29 and when actuated, brake assembly 40 acts on disc 39 to slow the uncoiler for reasons which will be hereinafter described. Thus, activation of motor 30 will turn disc 39 and the coils supported above it to pay off strip to the take-out assembly 12, now to be described in detail.

Figure 4:
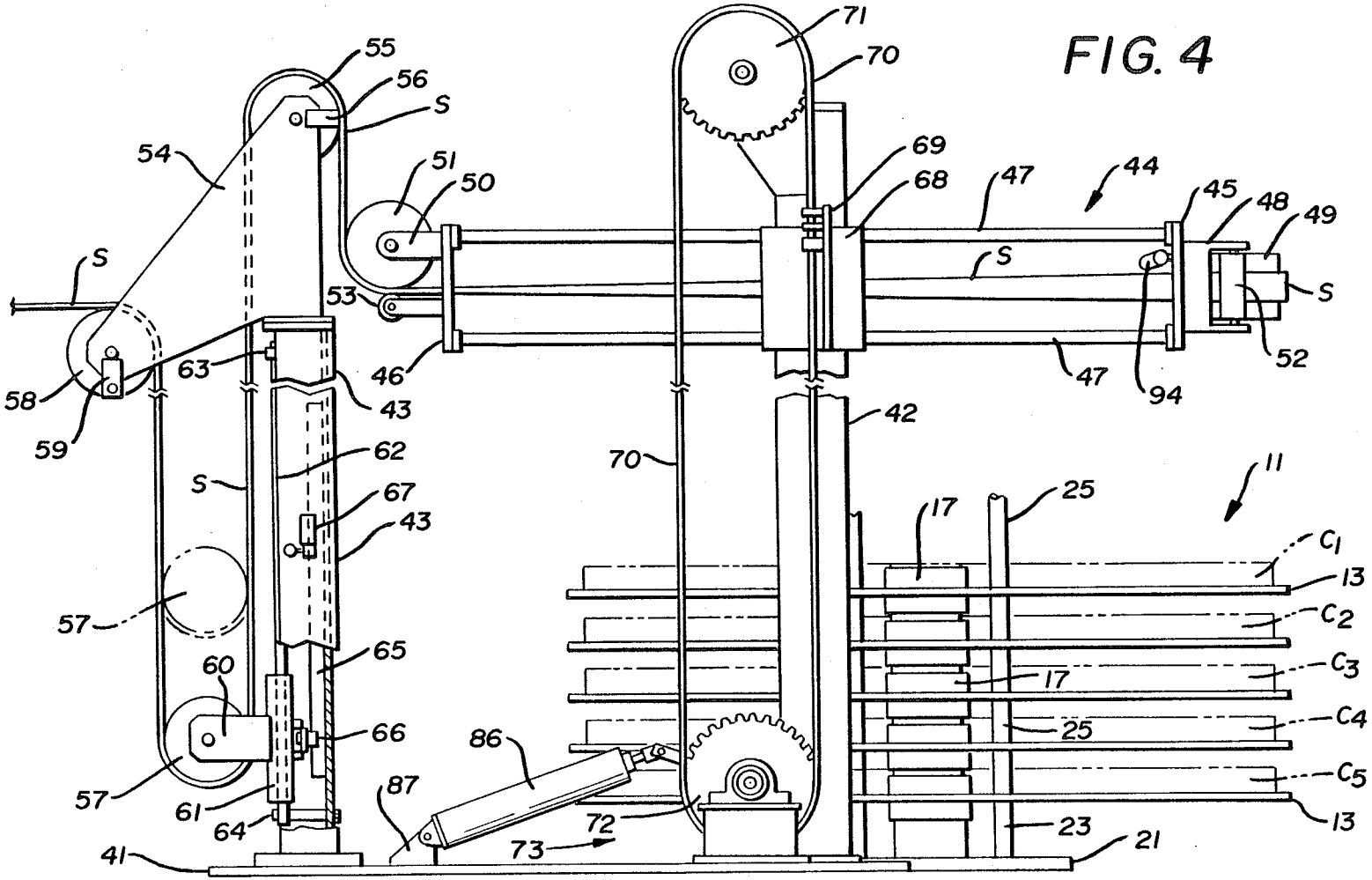
FIG. 4 is a partially sectioned elevational view of the system for supplying strip material to a processing line taken from the rear of the take-out assembly shown in FIG. 1.

Take-out assembly 12, best shown in FIGS. 1 and 4, includes a table base support 41 which carries two vertical stanchions 42, 43. Stanchion 42 carries a movable take-out arm generally indicated by the numeral 44. Take-out arm 44 is a box-like structure having end plates 45, 46 with four corne posts 47 therebetween. Plate 45 carries a bracket 48 which in turn carries idler roller 49 rotatable on a vertical axis and also carries a retaining roller 52 with strip S being received from the uncoiler assembly 11 between rollers 49 and 52. Similarly, plate 46 carries a bracket 50 which in turn carries idler roller 51 rotatable on a horizontal axis. Plate 46 also carries a retaining roller 53 also rotatable on a horizontal axis. After strip S passes between rollers 49 and 52 it is turned 90° as it travels along the length of take-out arm 44 and passes horizontally between rollers 51 and 53. The 90° turn is necessitated because the strip is vertically oriented on the coils C but normally must be horizontally oriented for the processing line. It should be appreciated, however, that the uncoiler assembly 11 could be designed to carry the coils in a vertical side-by-side relationship rather than a stacked relationship without departing from the spirit of this invention. In that instance it would not be necessary to effect the 90° turn in the take-out assembly 12.

Mounted on top of stanchion 43 are two cantilever plates 54 (one shown in FIG. 4) between which an idler roller 55 is journalled to receive the strip S after it passes around roller 51. A speed sensor 56, such as a conventional tachometer generator, is mounted on a plate 54 in proximity to roller 55 to sense the speed of roller 55, as by counting holes (not shown) in the side of the roller. The speed of roller 55 will be equivalent to the speed that strip is being payed off uncoiler assembly 11 and is used in controlling the same as will hereinafter be described.

The strip material then travels down around a movable dancer roller 57 and up around an exit roller 58 journalled between plates 54. After passing around roller 58, strip S proceeds to the processing line. Another speed sensor 59 mounted on a plate 54 in proximity to roller 58 senses the speed of roller 58, as by counting holes (not shown) in the side thereof. The speed of roller 58 will be equivalent to the speed of the processing line and is used in controlling the speed of the uncoiler assembly 11 as will hereinafter be described.

Stanchion 43 is shown as being a hollow generally U-shaped member having an open end facing dancer roller 57. Dancer roller 57 is mounted on a frame 60 which extends from a bearing support 61 that can travel along a guide rod 62 positioned at the open end of stanchion 43. Guide rod 62 is supported at the top and bottom by arms 63 and 64, respectively, extending from the back of stanchion 43. A dancer roller track 65 is mounted within stanchion 43. Rollers 66 (one shown) extend from bearing support 61 and ride on each side of track 65. Thus, dancer roller 57 is movable up and down on track 65 being guided by rod 62. As dancer roller 57 moves upwardly and downwardly, it engages and trips a position switch 67 which provides control signals to the uncoiler assembly 11. Essentially, when dancer roller 57 is above switch 67 and moving upward there is a small loop of strip therearound indicative that the strip demand of the processing line is greater than the speed of the uncoiler assembly 11. Conversely, when dancer roller 57 is below switch 67 and moving downward there is a large loop of strip therearound indicative that the uncoiler assembly 11 is paying out strip faster than the demand or speed of the processing line. Thus, switch 67 determines the position of dancer roller 57 and controls the speed of the uncoiler assembly 11 in a manner to be hereinafter described.

As shown in FIG. 1, during operation the take-out arm 44 is aligned with the coil on uncoiler assembly 11 currently being depleted. Thus, FIG. 1 shows roller 49 horizontally aligned with coil $C_1$. When coil $C_1$ becomes depleted and strip begins to pay off coil $C_2$, take-out arm 44 is indexed downwardly to become aligned with coil $C_2$. The manner in which this is accomplished is shown in FIG. 4 wherein, it should be pointed out, for clarity of depiction in the drawing, take-out arm 44 is shown well above the coils, it being understood that in operation roller 49 would be aligned with coil $C_1$ as shown in FIG. 1.

The manner in which take-out arm 44 is indexed will now be described in detail. A traveler block 68 is mounted on corner posts 47 of take-out arm 44 and rides in a conventional manner on tracks (not shown) on stanchion 42. A chain mounting arm 69 is affixed to block 68 and is attached to a link chain 70 which extends around a sprocket 71 rotatably attached to stanchion 42 and around a drive sprocket 72 of an indexing device generally indicated by the numeral 73.

Figures 5, 6:
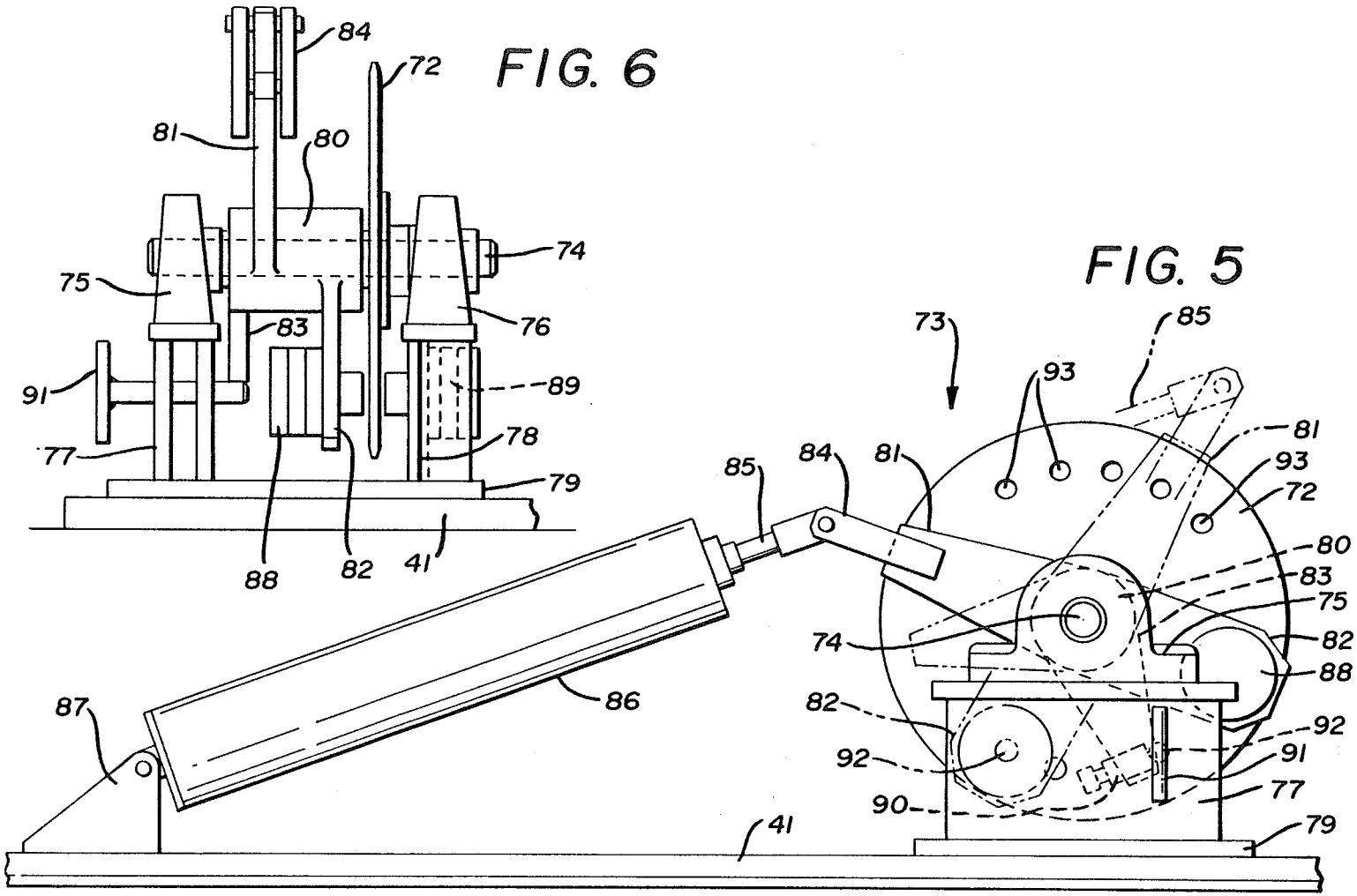
FIG. 5 is an enlarged view of an indexing device of the take-out assembly shown in FIG. 4 and showing two positions thereof, one being shown in phantom lines.
FIG. 6 is a side elevational view of the indexing device shown in phantom lines in FIG. 5.

The details of indexing device 73 are best shown in FIGS. 5 and 6. Sprocket 72 is mounted on shaft 74 which is rotatable within pillow blocks 75 and 76. Pillow blocks 75 and 76 are supported by bases 77 and 78, respectively, which extend upward from base plate 79 which is affixed to table base 41.

A crank arm hub 80, best shown in FIG. 6, extends around shaft 74 and is rotatable with respect to sprocket 72 and shaft 74. Hub 80 has a throw arm 81, a ratchet arm 82 and a tear drop shaped stop arm 83 extending generally radially therefrom. Throw arm 81 and ratchet arm 82 are axially offset from each other along hub 80 and are approximately 180° of each other around hub 80. Stop arm 83 is axially and angularly offset from both throw arm 81 and ratchet arm 82.

The radially outer end of throw arm 81 is affixed, as by clevis 84, to rod 85 of a cylinder 86 which is affixed by bracket 87 to table base 41. The radially outer end of ratchet arm 82 carries a small pneumatic cylinder 88 alignable, at the end of the stroke of cylinder 86, with another small pneumatic cylinder 89 carried by pillow block support base 78. The radially outer end of stop arm 83 carries an adjustment screw assembly 90 for engaging a stop pin 91 which can be selectively positioned in one of a plurality of holes 92 in pillow block support base 77.

The operation of indexing device 73 will now be described in detail. When a coil, such as $C_1$, has become depleted and coil is about to be payed off from the next serially connected coil, such as $C_2$, indexing device 73 will be activated. At this time cylinder rod 85, throw arm 81 and ratchet arm 82 are in the full line position of FIG. 5 with the position of stop arm 83 being shown in dotted lines at this time in FIG. 5 against stop pin 91. Cylinder 88 is activated to extend a pin (not shown) into one of the circumferentially spaced holes 93 in sprocket 72. While only a few holes 93 are shown for clarity in FIG. 5, it is to be understood that holes 93 are positioned around the entire circumference of sprocket 72. Then cylinder 86 strokes extending rod 85 outward to the chain line position in FIG. 5. Because the pin from cylinder 88 is engaging sprocket 72, it is thus moved clockwise to lower take-out arm 44 the desired amount to align it with coil $C_2$. At this point in time throw arm 81 and ratchet arm 82 are in the chain line position of FIG. 5 and the tear drop shaped stop arm 83, also shown in chain lines, is moved away from stop pin 91 a corresponding distance. It should be noted that side elevation FIG. 6 is taken, for clarity, at this point in the operating sequence.

Also at this point in the operation, cylinder 88, with its pin extended into a hole 93 in sprocket 72, is aligned with cylinder 89 as shown in FIG. 6. Then cylinder 89 extends a pin (not shown) into the same hole 93 as the pin from cylinder 88 is retracted. With the pin from cylinder 89 now in the particular hole 93, cylinder 86 is activated to retract rod 85 moving throw arm 81, ratchet arm 82, and stop arm 83 in a counterclockwise direction until adjustment screw assembly 90 contacts stop pin 91. Of course, sprocket 72 at this time is no longer engaged by the pin from clyinder 88 but rather held in place by the pin from cylinder 89 and will thus maintain take-out arm 44 aligned with coil $C_2$. By prepositioning pin 91 in the desired hole 92, the amount of retraction of cylinder rod 85 is controlled dependent on the width of the coil being processed. In other words, pin 91 is positioned in a hole 92 permitting cylinder rod 85 to retract only a distance calculated to move sprocket 72 on the next stroke a distance corresponding to the width of the coil.

The operation of the system 10 for supplying strip material to a processing line can now be described in detail. After a day's supply of coil have been interconnected and stacked on uncoiler drive assembly 26, the strip S is manually threaded through take-out assembly 12 with a sufficient loop of strip being provided such that dancer roller 57 is in a down position such as that shown in the full lines in FIG. 4. Cylinder 86 is stroked to extend rod 85 for a dry run and stop pin 91 is selectively positioned in the appropriate hole 92 dependent on the width of the strip being processed. The retraction of rod 85 will be stopped as stop arm 83 contacts pin 91 such that the next forward stroke will move take-out arm 44 a distance equal to the distance between the coils on the uncoiler assembly 11. With the pins from both cylinders 88 and 89 retracted, takeout arm 44 is manually aligned with the top coil of strip and a hole in sprocket 72 aligned with cylinder 88 rendering the system ready for operation.

As the processing line begins to demand strip, motor 30 of uncoiler assembly 11 is activated. Since dancer roller 57 is below position switch 67, uncoiler assembly 11 will initially be paying off strip at a slightly slower rate than the demand of the processing line, as determined by tachometer generator 59. As such, the size of the loop of strip around dancer roller 57 will decrease causing roller 57 to move upward as shown in chain lines in FIG. 4. When the dancer roller 57 moves past and trips switch 67, indicative that the demand of the processing line has exceeded the speed that strip material is being payed off from the uncoiler assembly 11, a signal is provided to the uncoiler assembly and motor 30 speeds up to provide strip material at a speed slightly greater than that of the processing line as determined by comparing the speeds as sensed by tachometer generators 56 and 59. Thus, more strip is provided to the take-out assembly 12 than is needed. As such, the loop around dancer roller 57 becomes larger and roller 57 moves back downward. When roller 57 passes by and trips switch 67, motor 30 will be directed to run at a speed to pay off strip slightly slower than the speed of the processing line, again as determined by comparing the speeds sensed by tachometer generators 56 and 59. In this manner the system will run continuously always satisfying the demand of the processing line with dancer roller 57 continually moving up and down as the relative speeds vary.

As the coil on uncoiler assembly 11 pays out its strip material the diameter thereof will, of course, be getting smaller and smaller and motor 30 will, consequently, have to run faster and faster to pay off the same amount of strip material. At the time a coil is about to be depleted, uncoiler assembly 11 will be driving the fastest and when the next coil starts to pay off strip material, uncoiler assembly 11 will be driving at its slowest speed to pay off the same amount of strip. This transition is assisted by brake assembly 40 in a manner now to be described.

When the last wrap of material begins to come off the coil being depleted, a reflective material (not shown) positioned on reinforcing collars 17 is uncovered and sensed by a photoelectric scanner light 94 (FIG. 4) mounted on plate 45 of take-out arm 44. This activates brake assembly 40 to clamp down on brake disc 39 to slow the uncoiler down until a speed sensor (not shown) located on the uncoiler detects that the uncoiler has reached the rotational speed required to pay off strip at the processing line speed from the outside of a new coil, at which time the brake will be disengaged. Simultaneously, cylinder 86 is energized to index take-out arm 44, as previously described, to align arm 44 with the new coil of strip. The process repeats itself at each transition thereby continuously supplying strip material to the processing line.

From the foregoing it should be evident that a system constructed and operated as herein described will continuously provide strip material at the demand of the processing line without the need for an strip accumulating device and thus substantially improves the strip handling and processing art.

I claim:

1. A system for supplying strip material according to the demand of a processing line comprising a strip uncoiler assembly and a strip take-out assembly; said uncoiler assembly including a plurality of adjacently positioned coils of strip material, each said coil lying in a plane and having its trailing end of strip material connected to the leading end of the strip material on the serially adjacent coil; said uncoiler assembly also including means to rotate said coils; said take-out assembly including means to receive strip material from said coils, means to index said means to receive strip material to align the same in said plane with the individual coil satisfying the demand of the processing line, and means responsive to the demand of the processing line to control said means to rotate said coils.

2. A system according to claim 1 wherein said uncoiler assembly further includes a plurality of plates each carrying a said coil.

3. A system according to claim 2 wherein each said plate is generally circular in nature having an interruption therein, said interruption providing a space for the trailing end of the strip material to pass to the leading end of the strip material on the serially adjacent coil.

4. A system according to claim 2 wherein each said plate has an aperture therein and a plurality of centering lugs positioned around said aperture, the inner diameter of each said coil being positioned around said lugs and centered on said plate by said lugs.

5. A system according to claim 4 wherein said uncoiler assembly further includes spacers positioned on said centering lugs to space adjacent of said coils.

6. A system according to claim 5 wherein said uncoiler assembly further includes a hollow shaft received through the apertures in said plates, said plates being positioned on said shaft in a spaced apart relationship as determined by the size of said spacers.

7. A system according to claim 6 wherein said means to rotate said coils includes a drive shaft inserted into said hollow shaft.

8. A system according to claim 1 wherein said means to rotate the coils includes a motor, and a shaft driven by said motor, said shaft carrying said coils of strip material.

9. A system according to claim 8 wherein said means to rotate the coils includes a drive train positioned between said motor and said shaft.

10. A system according to claim 1 wherein said plurality of adjacently positioned coils are stacked on a vertical axis, and wherein said means to receive strip material includes means to turn the strip material received therefrom generally 90°.

11. A system according to claim 1 wherein said take-out assembly includes a stanchion member carrying said means to receive strip material, said means to index moving said means to receive strip material along said stanchion member.

12. A system according to claim 11 wherein said means to index includes a first sprocket mounted on said stanchion, a second sprocket, and a chain drive extending around said sprockets and connected to said means to receive strip material.

13. A system according to claim 12 wherein said means to index includes drive means to index said second sprocket a predetermined distance.

14. A system according to claim 13 wherein said second sprocket is carried by a shaft, and wherein said means to index includes a hub extending around but movable with respect to said shaft, said drive means including means to rotate said hub a predetermined distance.

15. A system according to claim 14 wherein said drive means includes a throw arm on said hub, said means to rotate said hub a predetermined distance being connected to said throw arm.

16. A system according to claim 15 wherein said drive means includes a ratchet arm movable with said hub, and means on said ratchet arm to selectively engage said second sprocket.

17. A system according to claim 16 wherein said drive means includes a stop arm movable with said hub, and means to selectively stop the movement of said stop arm at a predetermined position.

18. A system according to claim 1 wherein said means responsive to the demand of the processing line includes dancer roller means receiving strip material from said means to receive strip material and providing the strip material to the processing line, there being a loop of strip material formed around said dancer roller means.

19. A system according to claim 18 wherein said take-out assembly further includes track means carrying said dancer roller, said dancer roller means being movable on said track means dependent on the demand of the processing line.

20. A system according to claim 19 wherein said means responsive to the demand of the processing line includes position switch means in the path of and engageable by said dancer roller means, said position switch means providing a signal to speed up said means to rotate said coils when said dancer roller means has engaged and is above said position switch means having a small loop of strip material therearound and providing a signal to slow down said means to rotate said coils when said dancer roller means has engaged and is below said position switch means having a large loop of strip material therearound.

21. A system according to claim 20 wherein said means responsive to the demand of the processing line includes means to detect the speed of the strip material passing to the processing line and means to detect the speed of the strip material coming from said uncoiler assembly.

22. A system for supplying strip material according to the demand of a processing line comprising a strip uncoiler assembly and a strip take-out assembly; said uncoiler assembly including a plurality of adjacently positioned coils of strip material, each said coil lying in a plane and having its trailing end of strip material connected to the leading end of the strip material on the serially adjacent coil; said uncoiler assembly also including a motor, a shaft driven by said motor and carrying said coils of strip material, a brake disc driven by said motor, and means to engage said brake disc to brake said motor; said take-out assembly including means selectively alignable in said plane with individual of said coils to receive strip material therefrom and means responsive to the demand of the processing line to control said motor.

23. A method of supplying strip material from and uncoiler assembly through a take-out assembly and to a processing line to satisfy the demand of the processing line for strip material comprising the steps of positioning a plurality of coils of strip material adjacent to each other and on the uncoiler assembly, each said coil being positioned in a plane, attaching the trailing end of each coil of strip material to the leading end of the strip material on the serially adjacent coil, aligning the take-out assembly in said plane with the coil of strip material currently satisfying the demand of the processing line, driving the uncoiler assembly to rotate the coils to pay off strip material to the take-out assembly, and controlling the driving of the uncoiler assembly dependent on the demand of the processing line.

24. A method according to claim 23 further comprising the step of detecting the end of strip material on the coil aligned with the take-out assembly.

25. A method according to claim 24 further comprising the step of braking the uncoiler assembly upon the detection of the end of strip material on the coil aligned with the take-out assembly.

26. A method according to claim 24 further comprising the step of indexing the take-out assembly upon detection of the end of strip material on the coil aligned with the take-out assembly to align the take-out assembly with the serially adjacent coil.

27. A method according to claim 26 wherein the step of indexing includes the steps of rotating a hub on a shaft and engaging a sprocket to rotate the same with the hub to move the take-out assembly.

28. A method according to claim 27 wherein the step of indexing includes the steps of disengaging the sprocket and rotating the hub in the opposite direction.

29. A method according to claim 28 wherein the step of indexing includes the step of restricting the rotation of the hub in the opposite direction to control the position of the take-out assembly the next time the sprocket is rotated with the hub.

30. A method according to claim 29 wherein the step of restricting includes the step of selectively positioning a stop pin to stop the rotation of the hub in the opposite direction.

31. A method according to claim 23 wherein the step of controlling the driving of the uncoiler assembly includes the steps of speeding up the paying off of strip material to the take-out assembly when the demand of the processing line is less than the speed at which strip material is being payed off to the take-out assembly and slowing down the paying off of strip material to the take-out assembly when the demand of the processing line is greater than the speed at which strip material is being payed off to the take-out assembly.

32. A method according to claim 31 wherein the step of controlling the driving of the uncoiler assembly includes the steps of monitoring the demand of the processing line and the speed that the strip material is being payed out by the uncoiler assembly to control the driving of the uncoiler assembly.

33. A method according to claim 23 wherein the step of controlling the driving of the uncoiler assembly includes the step of providing a loop of strip material around a dancer roller in the take-out assembly, the size of the loop controlling the driving of the uncoiler assembly.

34. A method according to claim 23 further comprising the step of selectively spacing the plurality of adjacent coils of strip material.

35. A method according to claim 23 wherein the step of positioning a plurality of coils of strip material includes the step of stacking the coils to rotate on a vertical axis and further comprising the step of turning the strip material approximately 90° in the take-out assembly.

36. A take-out assembly receiving strip material from a rotatable uncoiler assembly and paying off strip material from a plurality of adjacent interconnected coils of strip material each of which lies in a plane, to a processing line comprising a first roller receiving strip material from the uncoiler assembly, a second roller transmitting strip material to the processing line, a movable dancer roller between said first and second rollers and having a loop of strip material of variable length formed therearound, means to determine the position of said dancer roller to control the speed at which strip material is received from the uncoiler assembly, a take-out arm receiving strip material from a first coil of strip material paying out strip and providing the same to said first roller, and indexing means moving said take-out arm upon depletion of said first coil of strip material to align the same in said plane with the next serially adjacent coil of strip material.

37. A take-out assembly according to claim 36 further comprising first means to sense the speed of said first roller, second means to sense the speed of said second roller, said first and second means cooperating with said means to determine the position of said dancer roller to control the speed at which strip material is received from the uncoiler assembly.

38. A take-out assembly according to claim 36 further comprising guide rod means and track means to movably support said dancer roller.

39. A take-out assembly according to claim 36 wherein said take-out arm includes means to turn the strip material approximately 90°.

40. A take-out assembly according to claim 36 further comprising stanchion means movably carrying said take-out arm, said indexing means further comprising a first sprocket mounted on said stanchion, a second sprocket driven to move said take-out arm, and a chain drive extending around said first and second sprockets.

41. A take-out assembly according to claim 40, said indexing means further comprising hub means movable with and with respect to said second sprocket.

42. A take-out assembly according to claim 41, said indexing means further comprising a throw arm carried by said hub means, a ratchet arm carried by said hub means and selectively engaging said second sprocket, and cylinder means connected to said throw arm to move said second sprocket when engaged by said ratchet arm.

43. A take-out assembly according to claim 42, said indexing means further comprising a stop arm carried by said hub means, and stop means adjustably positioned in the path of said stop arm so that said stop means will engage said stop arm when said second sprocket is not engaged by said ratchet arm upon the retraction of said cylinder means to regulate the movement of said indexing means.

* * * * *